US008727403B2

(12) United States Patent
Johnson et al.

(10) Patent No.: US 8,727,403 B2
(45) Date of Patent: May 20, 2014

(54) LID SECURING ASSEMBLY

(75) Inventors: Lawrence W. Johnson, Taylor, MI (US); Harry W. Bothe, Royal Oak, MI (US); William S. Pippine, Waterford, MI (US)

(73) Assignee: Illinois Tool Works Inc., Glenview, IL (US)

( * ) Notice: Subject to any disclaimer, the term of this patent is extended or adjusted under 35 U.S.C. 154(b) by 648 days.

(21) Appl. No.: 12/353,512

(22) Filed: Jan. 14, 2009

(65) Prior Publication Data

US 2009/0243311 A1 Oct. 1, 2009

Related U.S. Application Data

(60) Provisional application No. 61/040,058, filed on Mar. 27, 2008.

(51) Int. Cl.
*E05B 15/02* (2006.01)

(52) U.S. Cl.
USPC ..... 292/340; 292/DIG. 14; 292/DIG. 55; 292/DIG. 42

(58) Field of Classification Search
USPC ..... 292/340, 341, 341.12, 341.13, 292/DIG. 14 X, DIG. 61, DIG. 55 X, DIG. 51, 292/DIG. 42 X
See application file for complete search history.

(56) References Cited

U.S. PATENT DOCUMENTS

| | | | | |
|---|---|---|---|---|
| 483,435 | A * | 9/1892 | Dunlap | 128/200.22 |
| 4,181,338 | A | 1/1980 | Sterling | |
| 4,225,166 | A * | 9/1980 | Tanaka et al. | 292/341.17 |
| 4,756,565 | A * | 7/1988 | Myslicki et al. | 292/340 |
| 4,883,298 | A * | 11/1989 | Kleefeldt | 292/341.12 |
| 5,825,288 | A * | 10/1998 | Wojdan | 340/542 |
| 5,937,585 | A * | 8/1999 | Tidbury et al. | 49/504 |
| 6,155,618 | A * | 12/2000 | Ichinose | 292/340 |
| 6,290,441 | B1 * | 9/2001 | Rusu | 410/106 |
| 6,616,204 | B1 * | 9/2003 | Mitts et al. | 292/341.18 |
| 7,025,395 | B2 * | 4/2006 | Fisher | 292/340 |
| 7,029,043 | B2 * | 4/2006 | Fisher | 292/341.13 |
| 7,344,169 | B2 * | 3/2008 | Han | 292/340 |
| 2002/0000727 | A1 | 1/2002 | Rass et al. | |
| 2003/0156447 | A1 * | 8/2003 | Kozicki | 365/151 |
| 2004/0104592 | A1 | 6/2004 | Fisher | |
| 2005/0077734 | A1 | 4/2005 | Lim | |

(Continued)

FOREIGN PATENT DOCUMENTS

| | | |
|---|---|---|
| DE | 2917517 A1 | 11/1979 |
| DE | 10308371 | 9/2004 |

(Continued)

OTHER PUBLICATIONS

International Search Report and Written Opinion for PCT/US2009031485.

*Primary Examiner* — Mark Williams
(74) *Attorney, Agent, or Firm* — Mark W. Croll; Paul F. Donovan

(57) ABSTRACT

A lid striker assembly is configured to mate with a latching assembly having a pawl. The lid striker assembly includes a plate, and at least one spring beam extending from the plate. The spring beam(s) is integrally formed with the plate as a single unit and is configured to exert a resistive force into the latching assembly when the lid striker assembly is secured to the latch assembly.

31 Claims, 6 Drawing Sheets

(56) References Cited

U.S. PATENT DOCUMENTS

| | | | | |
|---|---|---|---|---|
| 2005/0156447 | A1 | 7/2005 | Bishop et al. | |
| 2005/0253401 | A1 | 11/2005 | Han | |
| 2007/0114802 | A1* | 5/2007 | Johnson et al. | 292/340 |
| 2008/0116700 | A1* | 5/2008 | Snyder et al. | 292/341.12 |
| 2010/0090480 | A1* | 4/2010 | Pyun | 292/341.15 |
| 2010/0257786 | A1* | 10/2010 | Rock | 49/276 |
| 2010/0283271 | A1* | 11/2010 | Hemingway et al. | 292/341.15 |
| 2011/0025078 | A1* | 2/2011 | Gentile et al. | 292/341.12 |

FOREIGN PATENT DOCUMENTS

| | | | |
|---|---|---|---|
| DE | 102005050548 | | 5/2007 |
| DE | 102005050548 | A1 | 5/2007 |
| EP | 0894919 | A | 2/1999 |
| EP | 0894919 | | 3/1999 |
| EP | 1146185 | A | 10/2001 |
| FR | 605232 | A | 5/1926 |
| GB | 1294037 | A | 10/1972 |

* cited by examiner

LID SECURING ASSEMBLY

RELATED APPLICATIONS

This application relates to and claims priority benefits from U.S. Provisional Patent Application No. 61/040,058 entitled "Spring Assist Device For Vehicle Lid," filed Mar. 27, 2008, which is hereby incorporated by reference in its entirety.

FIELD OF EMBODIMENTS OF THE INVENTION

Embodiments of the present invention generally relate to a securing or latching assembly, and more particularly, to a securing assembly configured to assist with opening and closing a lid, such as a vehicle trunk or hood.

BACKGROUND

Many vehicles include lids, such as trunks and hoods, that may be opened by an operator to gain access to areas protected by the lids. For example, an operator may open a hood to gain access to an engine for servicing. Further, the operator may open a trunk lid to gain access to the trunk.

Typically, a latch is used to latchably engage a lid striker. The latch and lid striker are used in conjunction to ensure that a lid, such as a trunk lid or hood, remains securely closed during vehicle operation, while also allowing a user to open the lid when desired. Further, the latch and lid striker are generally configured to be robust enough to keep the lid(s) securely closed in the event of a vehicle accident.

FIG. 1 illustrates an isometric top view of a known lid striker 10. The lid striker 10 includes a base 12 configured to be secured to a lid, a separate and distinct striker bar 14 secured to the base 12, a pivot arm 16 pivotally secured to the base, a separate and distinct metal coil spring 18 having one end secured to an end of the pivot arm 16 and an opposite end secured to the stationary base 12, and additional components. In general, the lid striker 10 includes numerous pieces that are separately formed and assembled together to form the lid striker 10.

FIG. 2 illustrates an isometric top view of a known lid striker 20. Similar to the lid striker 10, the lid striker 20 includes a base 22, a striker bar 24 and a separate and distinct coil spring 26.

FIG. 3 illustrates an isometric top view of a known lid striker 30. Similar to the lid strikers 10 and 20, the lid striker 30 also includes a base 32, a striker bar 34 and a separate and distinct coil spring 36.

As shown in FIGS. 1-3, a spring device is operatively connected to the base of the lid striker. The lid striker, such as any of lid strikers 10, 20 or 30, is secured to either a frame or lid of a vehicle, while a latching device is secured to the other of the frame or lid. The latching device typically includes a pawl that is adapted to cooperate with the striker bar. The pawl locks around the striker to close the lid or door and is releasable by a mechanical or electrical component when a user desires to open the lid or door.

FIG. 4 illustrates an isometric view of the known lid striker 30 and a latching device 38. The latching device 38 includes a striker channel 40 that receives and guides the striker bar 34 into the pawl (hidden by the main body of latching device). When the door or lid is opened, the pawl is not stopped by the striker bar 34. The spring 36 exerts a force against the latch 38 when in a closed position. The spring force assists in securely holding the latch 38 to the striker bar 34. When released, the spring 36 assists in pushing the latch outward to open the lid or door. Typically, the spring 36 causes the door or lid to open a minimum amount to allow a user to fit his/her hand under the lid or door so that the user may grasp the door or lid.

The lid strikers 10, 20 and 30 include the metal coil springs 16, 26 and 36, respectively, that may be difficult to tune for any given door. Further, the springs 16, 26 and 36 may pose difficulties for manufacturers to optimally size for any given door. That is, because a particular door may differ in size, weight and the like when compared with another door, the springs 16, 26 and 36 may not operate optimally with each door. While a particular spring may function adequately with one style of door, that same spring may not function as well with another style of door. Generally, different springs may be required for varying force requirements.

SUMMARY OF EMBODIMENTS OF THE INVENTION

Certain embodiments of the present invention provide a lid striker assembly configured to mate with a latching assembly having a pawl. The lid striker assembly may include a plate, and at least one spring beam extending from the plate. The spring beam(s) is integrally formed with the plate as a single unit. That is, the spring beam(s) and the plate may be molded and/or stamped from a single piece of material, such as plastic or metal. The spring beam(s) is configured to exert a resistive force into the latching assembly when the lid striker assembly is secured to the latching assembly.

The lid striker assembly may include a striker bar secured to the plate. Optionally, the lid striker assembly may include a post integrally formed with an extending from the plate. The post member, such as the striker bar or the post, is configured to be securely engaged by a pawl within the latching assembly. The post member may include a ledge radially extending from a free end.

The at least one spring beam may include two spring beams symmetrical about a central axis of the plate. The spring beam(s) may include a distal hook and engagement tip.

The plate may include front edges that meet at an apex, such that the front edges recede toward lateral edges.

The spring beam(s) may include opposed flanges that, along with the spring beam(s), define a latch channel. The latch channel is configured to align the latch assembly with respect to the spring beam(s).

The spring beam(s) may also include a tapered leg connected to an enlarged latch-engaging tip. The latch-engaging tip may include an outwardly bowed section connected to a inwardly curling portion. Further, a force-reducing window may be formed through any portion of the spring beam(s).

Figure 1:
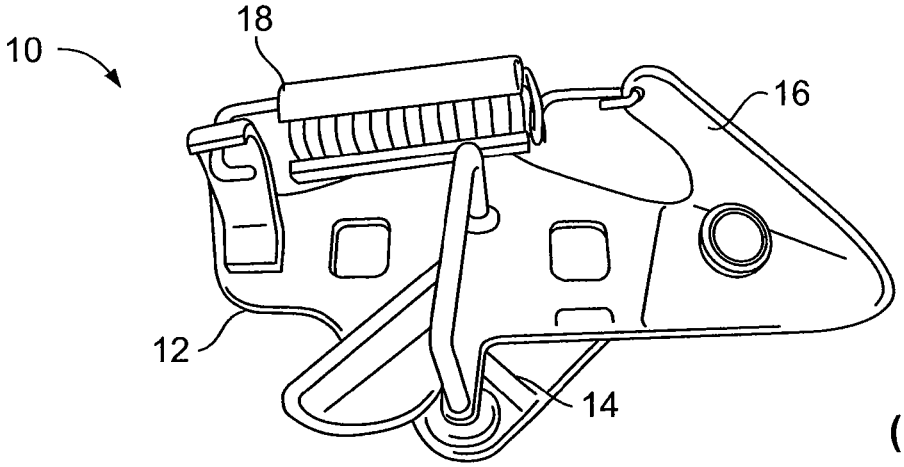
FIG. 1 (Prior Art)
FIG. 1 illustrates an isometric top view of a conventional lid striker.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF EMBODIMENTS OF THE INVENTION

Figure 5:
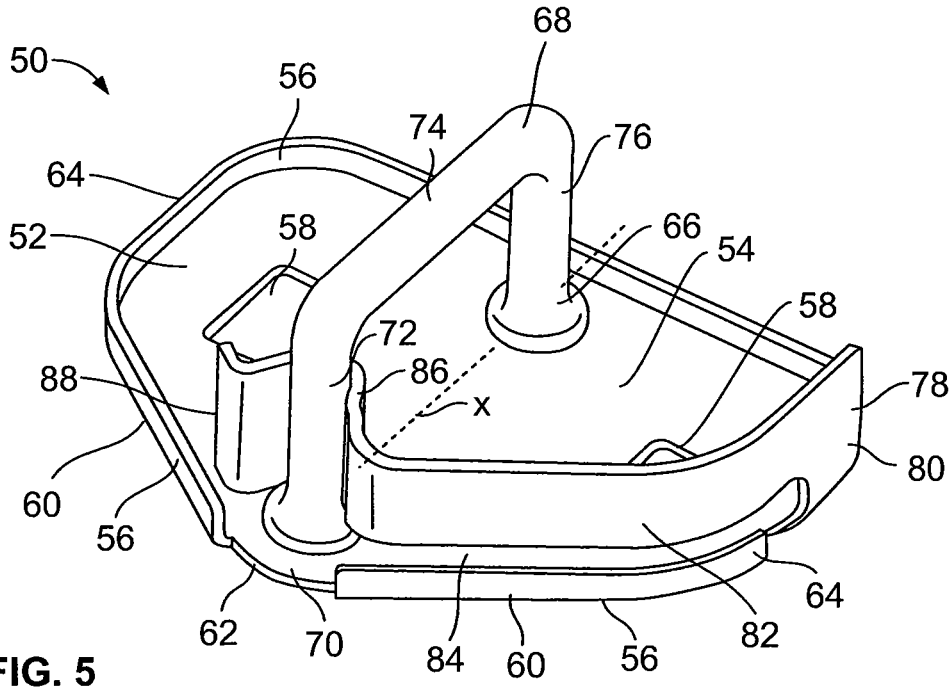
FIG. 5 illustrates an isometric top view of a lid striker assembly, according to an embodiment of the present invention.

FIG. 5 illustrates an isometric top view of a lid striker assembly 50, according to an embodiment of the present invention. The assembly 50 includes a plate 52 having a generally planar base 54 and upturned edges 56 that provide strength to the plate 52. Fastener openings 58 are formed through the plate 52 and are configured to allow fasteners to pass therethrough, so that the assembly 50 may be secured to a vehicle component, such as a lid, door or frame.

Front edges 60 of the plate 52 are angled and meet at an apex 62. The front edges 60 recede toward lateral edges 64, which, in turn, connect to a generally straight rear edge 66. As shown, the plate 52 roughly resembles a home plate of a baseball field. The angled nature of the front edges 60 allows for easier mating with a latching assembly. Alternatively, however, the base plate 52 may be a different shape, such as a square or rectangle.

A striker bar 68 extends from an upper surface of the base 54 along a central axis X of the plate 52. A gap 70 is formed between the upturned edges 56 proximate the apex 62. The gap 70 allows the striker bar 68 to enter an engagement chamber of a latch assembly (not shown in FIG. 5).

The striker bar 62 includes a leading post 72 integrally connected to a beam 74, which, in turn, is integrally connected to a trailing post 76. The posts 72 and 76 are generally perpendicular to the base 54, while the beam 74 is generally parallel with the base 54.

The striker bar 68 may be a separate and distinct piece that is formed separately from the plate 52. Optionally, the striker bar 68 may be integrally formed with the plate 52.

An integral spring beam 78 extends upwardly from a lateral edge 64 of the plate 52. The spring beam 78 is integrally formed with the plate 52 and includes a root 80 that extends upwardly from the plate 52 proximate a union of one of the lateral edges 64 and the rear edge 66. The root 80 extends above the upturned edges 56 and generally follows the contours of the lateral edge 64 and front edge 60 when in an at-rest state.

A flexible spring leaf 82 extends from the root 80 and is separated from the upturned edge 56 of the front edge 60 by a gap 84. A hook 86 extends from a distal end of the spring leaf 82 and wraps around a rear surface (with respect to the leading direction of the assembly 50) of the leading post 72. An engagement tip 88 extends from the hook 86 on the opposite side of the leading post 72 than the main portion of the spring leaf 82. As shown in FIG. 5, the hook 86 and the engagement tip 88 wrap around the leading post 72 of the striker bar 68 to provide an additional surface (in relation to the main body of the spring leaf 82) that may exert a resistive force into a latch assembly.

The spring beam 78 flexes inwardly when first engaged by a latch assembly. During this movement, the hook 86 disengages the leading post 72. As the striker beam 68 fully engages a pawl within the latch assembly, the spring beam 78 exerts a resistive, engaging force into the latch assembly, thereby ensuring the assembly 50 remains secured to the latch assembly. When a user acts to disengage the assembly 50 from a latch assembly, the resistive force of the spring beam 78 assists in ejecting the assembly 50 from the latch assembly.

Figure 2:
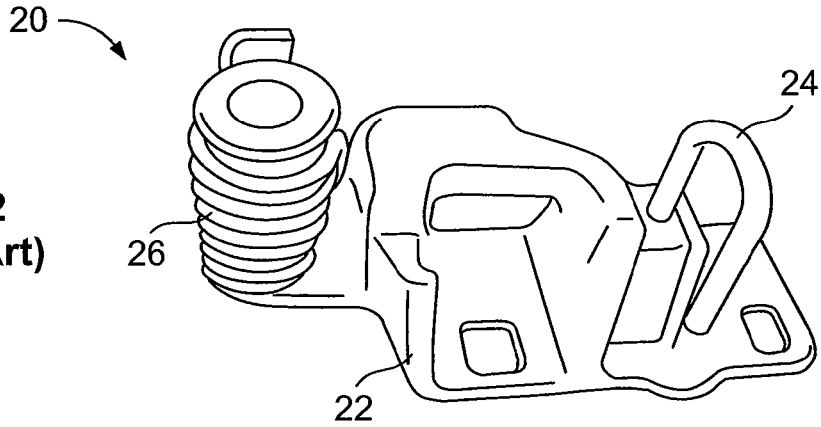
FIG. 2 (Prior Art)
FIG. 2 illustrates an isometric top view of a conventional lid striker.
Figure 3:
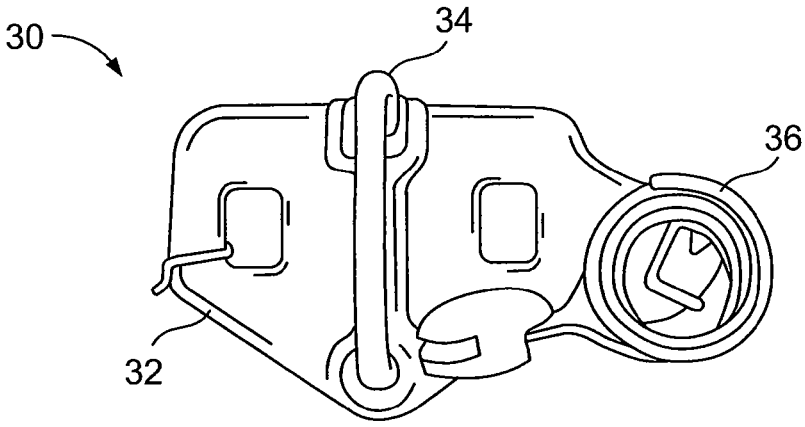
FIG. 3 (Prior Art)
FIG. 3 illustrates an isometric top view of a conventional lid striker.

The spring leaf 82 is cantilevered on the plate 52 about the root 80. The width of the spring leaf 82 may be modified to provide varying force loads. Because the plate 52 includes an integral spring beam 78, the assembly 50 is easier and quicker to manufacture than the known devices 10, 20 and 30 shown in FIGS. 1-3, respectively. Due to the assembly 50 including the integral spring leaf 82, there is no need to pick an appropriate separate coiled spring and secure it to the assembly.

Figure 6:
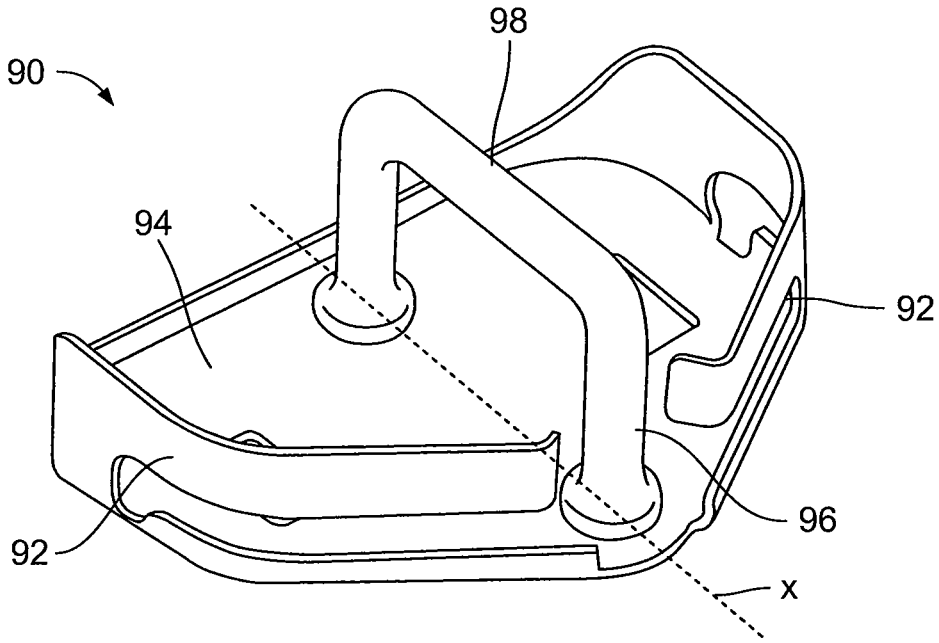
FIG. 6 illustrates an isometric top view of a lid striker assembly, according to an embodiment of the present invention.

FIG. 6 illustrates an isometric top view of a lid striker assembly 90, according to an embodiment of the present invention. The assembly 90 is similar to the assembly 50, except that the assembly 90 includes two spring beams 92 that are symmetrical about the central axis X of the plate 94. The spring beams 92 are generally mirror images of one another. Further, the spring beams 92 do not include hook portions that engage the leading post 96 of the striker bar 98. Optionally, however, one or both spring beams 92 may include hook portions.

The inclusion of an additional spring beam 92 provides an additional engagement surface with a latch assembly. Further, the additional spring beam 92 provides increased spring force to the assembly 90. The symmetrical spring beams 92 balance loading on a latch, as opposed to a single spring beam.

Figure 4:
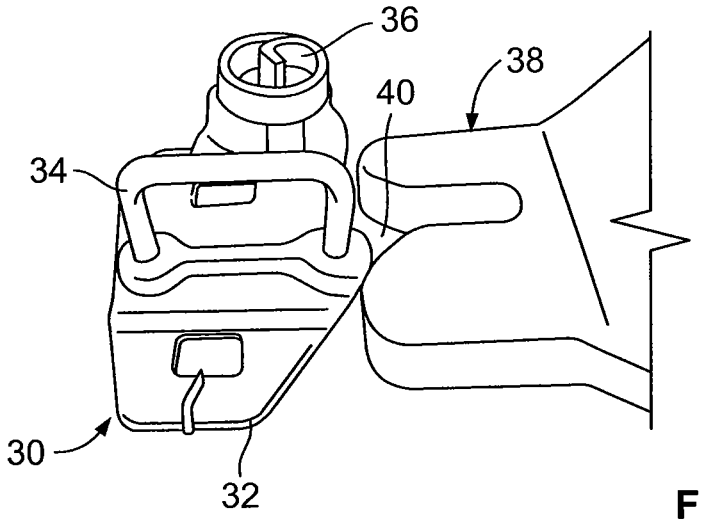
FIG. 4 (Prior Art)
FIG. 4 illustrates an isometric view of a known lid striker and a latching device.
Figure 7:
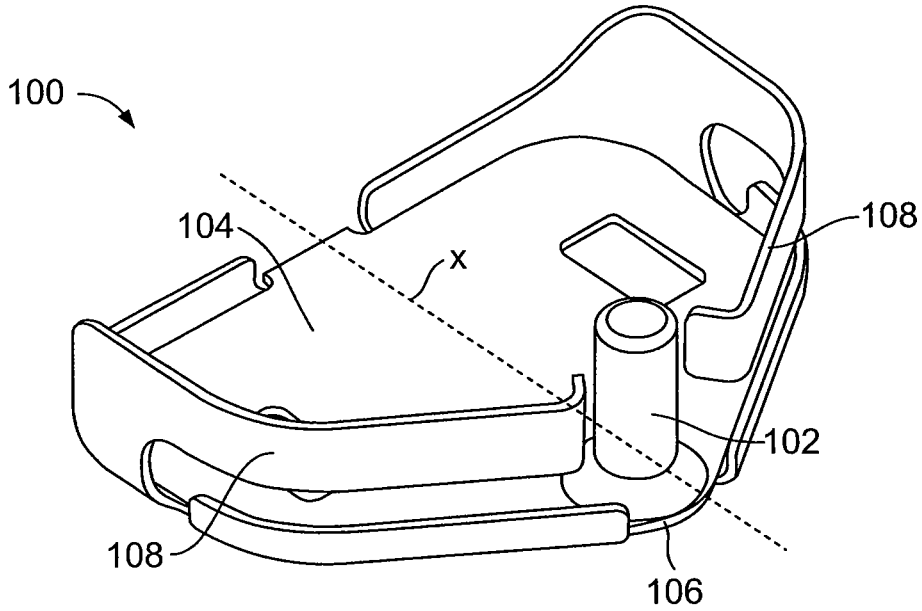
FIG. 7 illustrates an isometric top view of a lid striker assembly, according to an embodiment of the present invention.

FIG. 7 illustrates an isometric top view of a lid striker assembly 100, according to an embodiment of the present invention. The assembly 100 may be similar to the either the assemblies 50 or 90, except that the assembly 100 does not include a separate and distinct spring bar. Instead, a post 102 is integrally formed with the base 104 and extends upwardly therefrom. Generally, the post 102 is perpendicular to the base 104. The post 102 is set back from the apex 106 and is configured to engage a pawl of a latching assembly similar to how a leading post of a striker bar engages the pawl. However, the post 104 is integrally formed with the assembly 100. Thus, the assembly 100 provides the additional benefit of being formed as a single unit without the need for a separate and distinct striker bar. While the assembly 100 is shown having two symmetrical (about the central axis X) spring beams 108, the assembly 100 may alternatively include the single spring beam 78, shown in FIG. 4.

Figure 8:
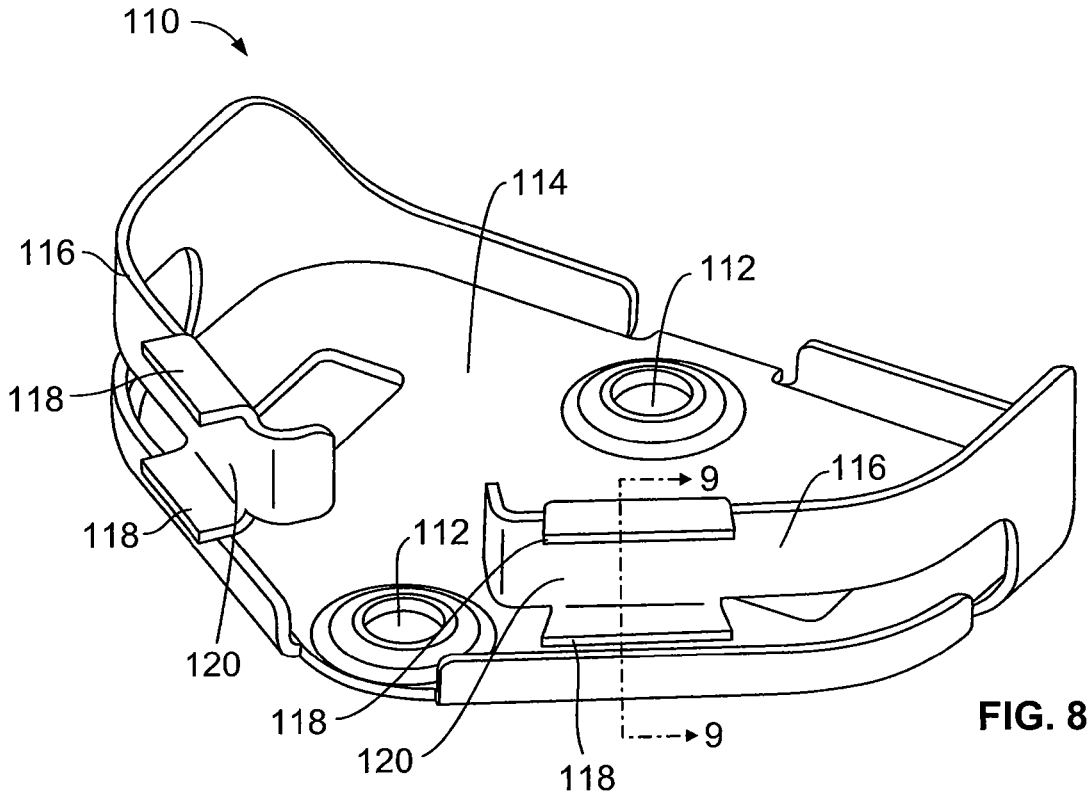
FIG. 8 illustrates an isometric top view of a lid striker assembly, according to an embodiment of the present invention.

FIG. 8 illustrates an isometric top view of a lid striker assembly 110, according to an embodiment of the present invention. The lid striker assembly 110 may be configured to receive and retain a separate striker bar through securing holes 112 formed through the base 114. Optionally, the assembly 110 may include an integrally formed post, as shown and described with respect to FIG. 7.

The assembly 110 includes spring beams 116, such as shown and described with respect to FIGS. 6 and 7. However, the spring beams 116 include opposed flanges 118 that outwardly extend from upper and lower edges of the spring beams 116. The flanges 118 may extend along more or less of the spring beams 116 than as shown in FIG. 8. The flanges 118 are generally perpendicular to the front surfaces of the spring beams 116. As such, a U-shaped channel 120 is formed between the opposed flanges 118 and the spring beam 116.

Figure 9:
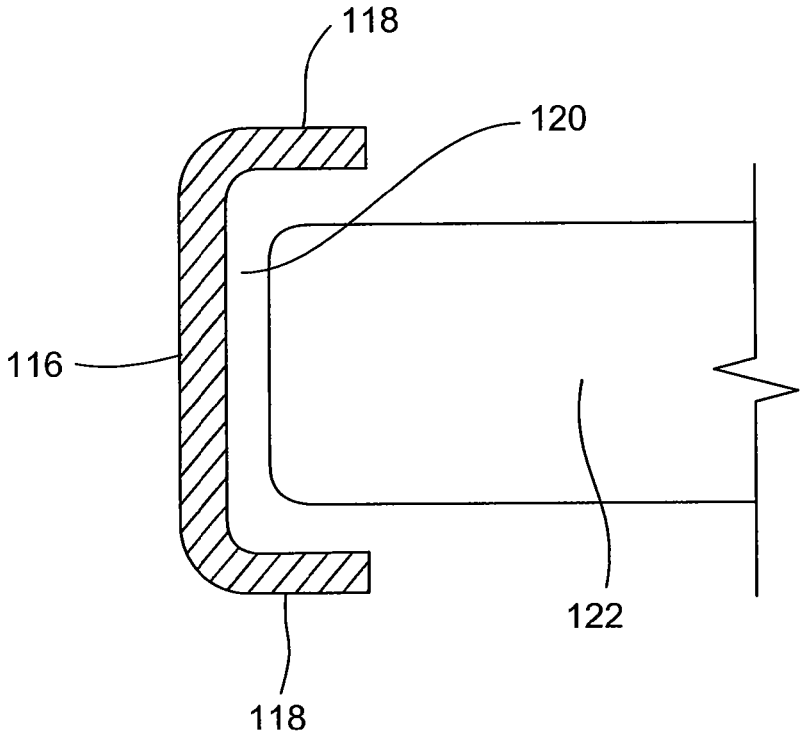
FIG. 9 illustrates a cross-sectional view of a spring beam through line 9-9 of FIG. 8, according to an embodiment of the present invention.

FIG. 9 illustrates a cross-sectional view of the spring beam 116 through line 9-9 of FIG. 8, according to an embodiment of the present invention. A latch front edge 122 is configured to be retained within the U-shaped channel 120. As such, the flanges 118 assist in centering the latch front edge 122 with respect to the spring beams 116 in order to properly align the assembly 110 with respect to the latch assembly. The opposed flanges 118 may be used with any of the embodiments shown and described with respect to FIGS. 5-7.

Figure 10:
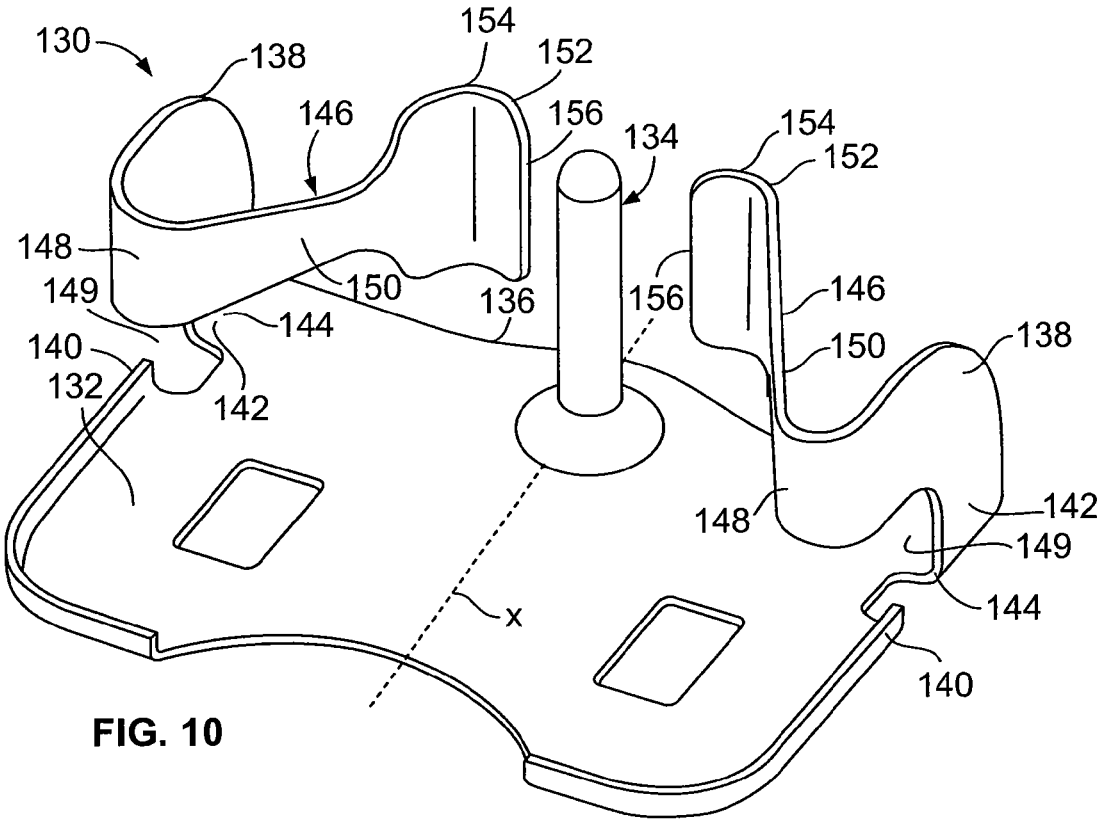
FIG. 10 illustrates an isometric top view of a lid striker assembly, according to an embodiment of the present invention.

FIG. 10 illustrates an isometric top view of a lid striker assembly 130, according to an embodiment of the present invention. The assembly 130 includes a plate 132 having an integrally formed post 134 extending proximate a front edge 136 along a central axis X.

Spring beams 138 extend from either side of the plate 132 proximate the union of lateral edges 140 and the front edge 136. The spring beams 138 are symmetrical about the central axis X and are generally mirror images of one another.

Each spring beam 138 includes a root 142 upwardly extending from the plate 132 proximate the front edge 136 on the sides of the plate 132. The root 142 integrally connects to the plate through a curved strap 144. The root 142 is generally perpendicular to the plate 132.

The root 142 connects to a spring beam 146 through a curved strap 148 that angles the spring beam 146 inwardly and toward the front edge 136. The curved strap 148 is separated from the plate 132 by a space 149. The spring beam 146 includes a tapered leg 150 that tapers from the strap 148 toward an expanded distal latch-engaging tip 152. The latch-engaging tip 152 is wider than the leg 150 and generally outwardly bows and curls back in toward post 134. The latch-engaging tip 152 is configured to abut into the latch assembly. The outward bowing 154 and inward curling 156 of the latch-engaging tip 152 provides additional spring force into the latch assembly, while at the same time ensuring that the latch-engaging tip does not snag any portion of the latch assembly.

The legs 150 are tapered in order to reduce stresses during flexing and bending. The tapered legs 150, consequently, resist cracking over time.

While the assembly 130 is shown with an integrally formed post 134, the assembly 130 may, alternatively, include a striker bar.

Figure 11:
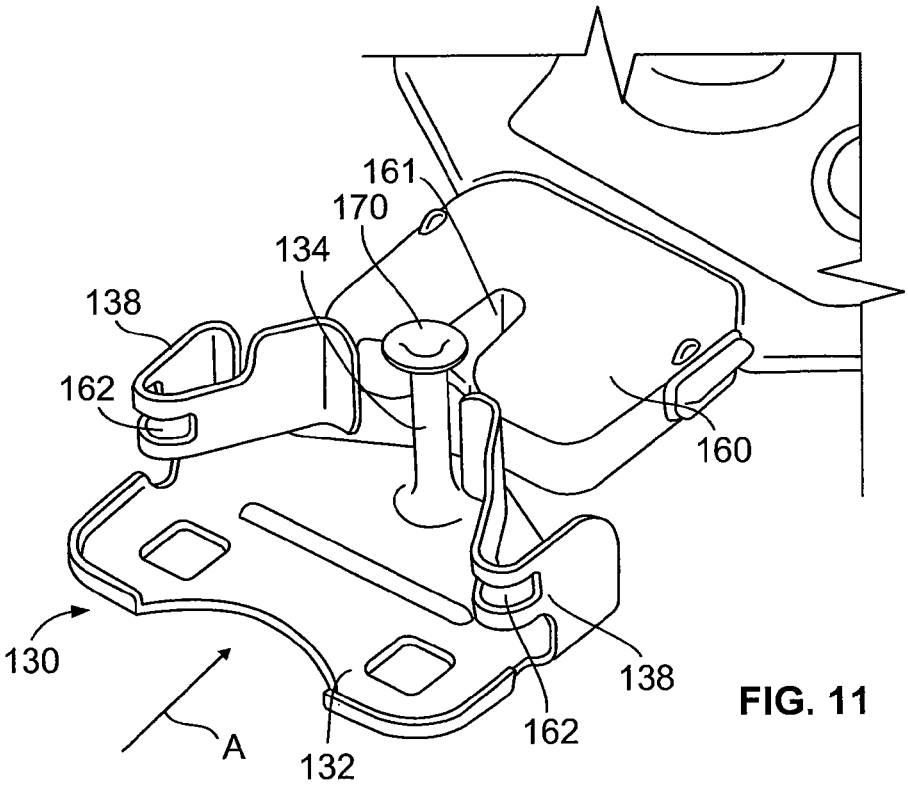
FIG. 11 illustrates an isometric top view of a lid striker assembly aligned with a latch assembly in a pre-engaged position, according to an embodiment of the present invention.

FIG. 11 illustrates an isometric top view of the lid striker assembly 130 aligned with a latch assembly 160 in a pre-engaged position, according to an embodiment of the present invention. As noted previously, the lid striker assembly 130 may be secured to a lid, such as a hood or trunk door, while the latch assembly 160 may be secured to a vehicle frame. In the pre-engaged position, the post 134 is aligned with a channel 161 formed in the latch assembly 160. As shown in FIG. 11, windows 162 may be formed through the spring beams 138. The windows 162 decrease the amount of force that the spring beams 138 exert into the latch assembly 160. That is, the windows 162 may be formed through the spring beams 138 if less exerted force is desired. Optionally, the windows may not be formed through the spring beams 138.

In order to secure the lid striker assembly 130 to the latch assembly, the lid striker assembly 130 is urged toward the latch assembly 160 in the direction of arrow A.

Figure 12:
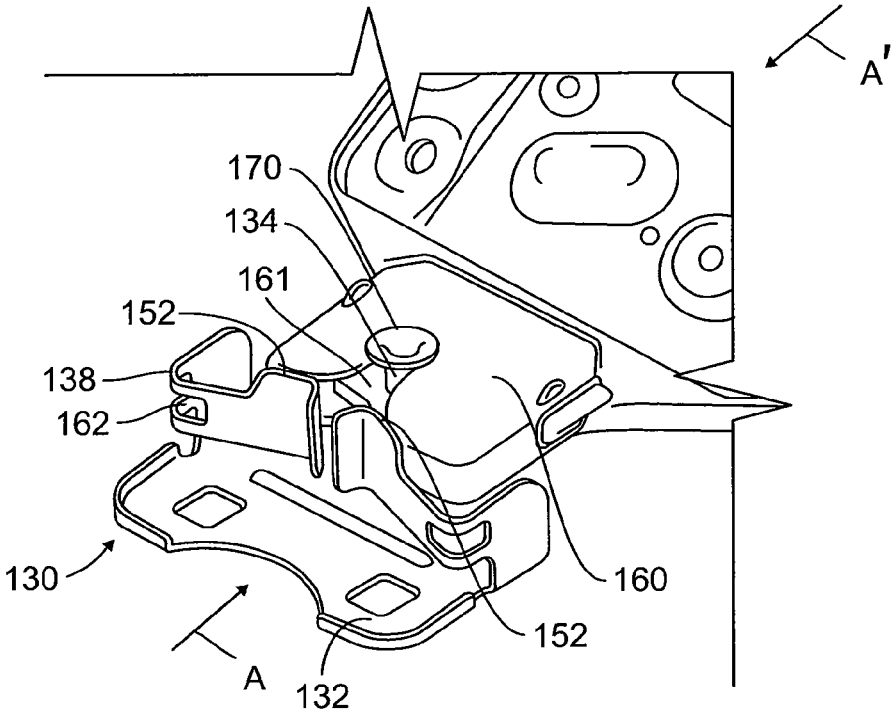
FIG. 12 illustrates an isometric top view of a lid striker assembly engaged by a latch assembly, according to an embodiment of the present invention.

FIG. 12 illustrates an isometric top view of the lid striker assembly 130 engaged by the latch assembly 160. In this position, the post 134 is fully mated into the channel 161 and a pawl (not shown) securely engages around the post 134. The latch-engaging tips 152 abut into front edges of the latch assembly 160, which flexes the latch-engaging tips 152 and therefore the spring beams 138 back in the direction of arrow A'. However, the spring beams 138 exert an equal but opposite force in the direction of arrow A into the latch assembly 160, thereby assisting in securing the lid striker assembly 130 to the latch assembly 160. When a user disengages the latch assembly 160 from the lid striker assembly 130 such that the pawl disengages the post 134, the force exerted by the spring beams 134 into the latch assembly 160 assists in ejecting the lid striker assembly 130 from the latch assembly 160.

As shown in FIGS. 11 and 12, a ledge 170 may radially extend from a top of the post 134. The ledge 170 provides a securing feature that prevents the latch assembly 160 from upwardly dislodging from the lid striker assembly 130. The plate 132 (which extends underneath a front of the latch assembly 160 in the engaged position) prevents the latch assembly 160 from downwardly dislodging from the lid striker assembly 130. The ledge 170 and the plate 132 prevent the assemblies 130 and 160 from separating if an unexpected force is exerted on the components, such as during a vehicle crash.

Figure 13:
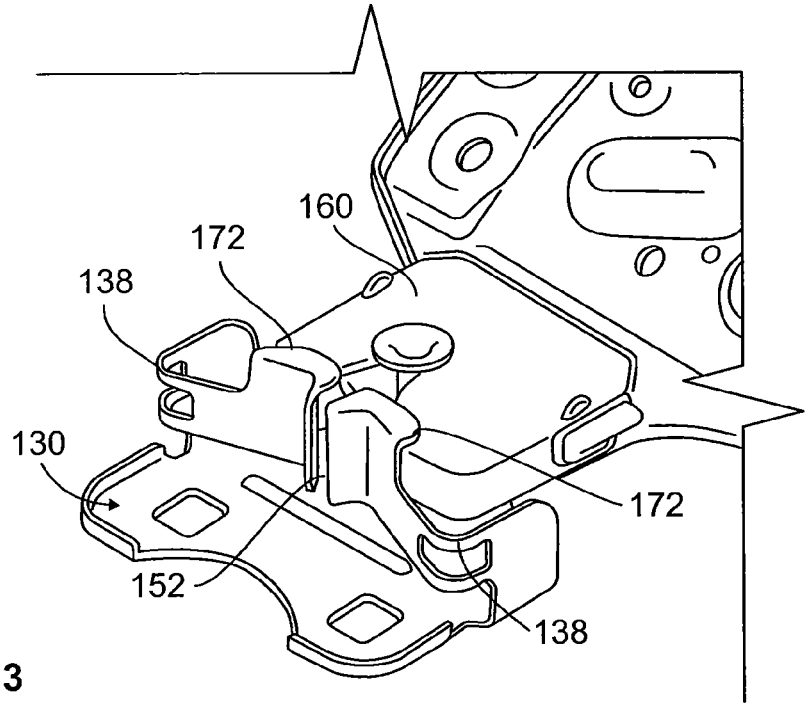
FIG. 13 illustrates an isometric top view of a lid striker assembly engaged by a latch assembly, according to an embodiment of the present invention.

FIG. 13 illustrates an isometric top view of the lid striker assembly 130 engaged by the latch assembly 160. The spring beams 138 may include alignment flanges 172 extending from upper and lower edges of the latch-engaging tips 152, similar to the those described above in FIGS. 8-9.

Thus, embodiments of the present invention provide a lid striker assembly that is easier to manufacture and assemble than known lid strikers. The lid striker assemblies shown and described in FIGS. 5-13 include less parts to assemble than the known lid strikers. Indeed, embodiments of the present invention may be molded and formed from a single piece of material, such as a one piece stamping of plastic or metal. Consequently, embodiments of the present may also be lighter, yet more robust (due to no connection interfaces between separate and distinct components) than known lid strikers.

While various spatial and directional terms, such as top, bottom, lower, mid, lateral, horizontal, vertical, front and the like may used to describe embodiments of the present invention, it is understood that such terms are merely used with respect to the orientations shown in the drawings. The orientations may be inverted, rotated, or otherwise changed, such that an upper portion is a lower portion, and vice versa, horizontal becomes vertical, and the like.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

The invention claimed is:

1. A lid striker assembly configured to mate with a latching assembly having a pawl, the lid striker assembly comprising:

a plate;

a column extending from said plate; and at least one spring beam extending from said plate, said at least one spring beam being integrally molded and formed with said plate as a single unit from a single piece of material, said at least one spring beam configured to exert a resistive force into the latching assembly when the lid striker assembly is secured to the latching assembly, such that said at least one spring beam is positioned relative to said column so that the latching assembly engages said at least one spring beam before the pawl is secured to the column, and such that upon disengagement of the latching assembly from the lid striker assembly, the resistive force of said at least one spring beam assists in ejecting the latching assembly from the lid striker assembly.

2. The lid striker assembly of claim 1, wherein said column is a striker bar secured to said plate.

3. The lid striker assembly of claim 1, wherein said column is a post integrally formed with said plate.

4. The lid striker assembly of claim 3, wherein said post comprises a ledge radially extending from a free end.

5. The lid striker assembly of claim 1, wherein said at least one spring beam comprises two spring beams symmetrical about a central axis of said plate.

6. The lid striker assembly of claim 1, wherein said at least one spring beam comprises a distal hook and engagement tip.

7. The lid striker assembly of claim 1, wherein said plate comprises front edges that meet at an apex, said front edges receding toward lateral edges.

8. The lid striker assembly of claim 1, wherein said at least one spring beam comprises opposed flanges that outwardly extend from upper and lower edges of said at least one spring beam, said opposed flanges and said at least one spring beam defining a latch channel, wherein said latch channel is configured to align the latch assembly with respect to said at least one spring beam.

9. The lid striker assembly of claim 1, wherein said at least one spring beam comprises a tapered leg connected to an enlarged latch-engaging tip.

10. The lid striker assembly of claim 1, wherein said at least one spring beam comprises at least one window formed therethrough.

11. A lid striker assembly configured to mate with a latching assembly having a pawl, the lid striker assembly comprising:

a plate comprising a base and upturned edges, wherein at least one fastener through-hole is formed through said base, said fastener through-hole being configured to receive a fastener that secures the lid striker assembly to a portion of a vehicle; and at least one spring beam extending from said plate, wherein said at least one spring beam comprises a root having a portion extending directly from said plate and a leaf spring connected to said root, said root portion being perpendicular to said base and said leaf spring being generally parallel to said base, said at least one spring beam being integrally molded and formed with said plate as a single unit from a single piece of material, said at least one spring beam configured to exert a resistive force into the latching assembly when the lid striker assembly is secured to the latching assembly, and said at least one spring beam further configured to assist in ejecting the latching assembly from the lid striker assembly upon disengagement of the latching assembly from the lid striker assembly.

12. The lid striker assembly of claim 11, comprising a striker bar secured to said plate, said striker bar being configured to be securely engaged by a pawl within the latching assembly.

13. The lid striker assembly of claim 11, comprising a post integrally formed with and extending from said base, said post being configured to be securely engaged by a pawl within the latch assembly.

14. The lid striker assembly of claim 13, wherein said post comprises a ledge radially extending from a free end, said ledge preventing the lid striker assembly from dislodging from the latching assembly in a direction that is perpendicular to said ledge.

15. The lid striker assembly of claim 11, wherein said at least one spring beam comprises two spring beams symmetrical about a central axis of said plate.

16. The lid striker assembly of claim 11, wherein said at least one spring beam comprises a distal hook and engagement tip.

17. The lid striker assembly of claim 11, wherein said plate comprises front edges that meet at an apex, said front edges receding toward lateral edges.

18. The lid striker assembly of claim 11, wherein said at least one spring beam comprises opposed flanges that outwardly extend from upper and lower edges of said at least one spring beam, said opposed flanges and said at least one spring beam defining a latch channel, wherein said latch channel is configured to align the latch assembly with respect to said at least one spring beam.

19. The lid striker assembly of claim 11, wherein said leaf spring comprises a tapered leg connected to an enlarged latch-engaging tip.

20. The lid striker assembly of claim 11, wherein said at least one spring beam comprises at least one window formed therethrough.

21. A lid striker assembly configured to mate with a latching assembly having a pawl, the lid striker assembly comprising:

a plate comprising a base and upturned edges, wherein at least one fastener through-hole is formed through said base;

at least one spring beam extending from said plate, wherein said at least one spring beam comprises a root and a leaf spring connected to said root, said root being perpendicular to said base, said at least one spring beam being integrally molded and formed with said plate as a single unit from a single piece of material, said at least one spring beam configured to exert a resistive force into the latching assembly when the lid striker assembly is secured to the latching assembly, said at least one spring beam comprising opposed flanges that outwardly extend from upper and lower edges of said at least one spring beam, said opposed flanges and said at least one spring beam defining a latch channel, wherein said latch channel is configured to align the latch assembly with respect to said at least one spring beam; and a post member integrally formed with and extending from said base, said post member being configured to be securely engaged by a pawl within the latch assembly.

22. The lid striker assembly of claim 21, wherein said post member comprises a ledge radially extending from a free end, said ledge preventing the lid striker assembly from dislodging from the latching assembly in a direction that is perpendicular to said ledge.

23. The lid striker assembly of claim 21, wherein said plate comprises front edges that meet at an apex, said front edges receding toward lateral edges.

24. The lid striker assembly of claim 21, wherein said leaf spring comprises a tapered leg connected to an enlarged latch-engaging tip.

25. The lid striker assembly of claim 21, wherein said at least one spring beam comprises at least one window formed therethrough.

26. The lid striker assembly of claim 1, wherein at least a portion of said at least one spring beam is located at a leading edge of said plate, and wherein said at least a portion of said at least one spring beam is configured to directly contact the latching assembly.

27. The lid striker assembly of claim 11, wherein at least a portion of said at least one spring beam is located at a leading edge of said plate, and wherein said at least a portion of said at least one spring beam is configured to directly contact the latching assembly.

28. The lid striker assembly of claim 21, wherein at least a portion of said at least one spring beam is located at a leading edge of said plate, and wherein said at least a portion of said at least one spring beam is configured to directly contact the latching assembly.

29. The lid striker assembly of claim 1, wherein the at least one spring is configured to exert the resistive force into the latching assembly to ensure that the lid striker assembly secures to the latching assembly, and wherein during disengagement, the resistive force exerted by the at least one spring beam assists in ejecting the lid striker assembly from the latching assembly.

30. The lid striker assembly of claim 11, wherein the at least one spring is configured to exert the resistive force into the latching assembly to ensure that the lid striker assembly secures to the latching assembly, and wherein during disengagement, the resistive force exerted by the at least one spring beam assists in ejecting the lid striker assembly from the latching assembly.

31. The lid striker assembly of claim 21, wherein the at least one spring is configured to exert the resistive force into the latching assembly to ensure that the lid striker assembly secures to the latching assembly, and wherein during disengagement, the resistive force exerted by the at least one spring beam assists in ejecting the lid striker assembly from the latching assembly.

* * * * *